US010947633B2

(12) United States Patent
Sugiyama et al.

(10) Patent No.: US 10,947,633 B2
(45) Date of Patent: Mar. 16, 2021

(54) METHOD OF PRODUCING ELECTROCAST BELT

(71) Applicants: NOK CORPORATION, Tokyo (JP); SYNZTEC CO., LTD., Tokyo (JP)

(72) Inventors: Shingo Sugiyama, Kanagawa (JP); Akira Nishida, Kanagawa (JP); Masaya Suzuki, Kanagawa (JP); Minoru Takeda, Tokyo (JP)

(73) Assignees: NOK CORPORATION, Tokyo (JP); SYNZTEC CO., LTD., Tokyo (JP)

( * ) Notice: Subject to any disclaimer, the term of this patent is extended or adjusted under 35 U.S.C. 154(b) by 1250 days.

(21) Appl. No.: 14/080,051

(22) Filed: Nov. 14, 2013

(65) Prior Publication Data

US 2014/0224660 A1 Aug. 14, 2014

(30) Foreign Application Priority Data

Feb. 13, 2013 (JP) ..... JP2013-026055

(51) Int. Cl.
*C25D 1/02* (2006.01)
*G03G 15/20* (2006.01)
*C25D 3/12* (2006.01)

(52) U.S. Cl.
CPC ..... *C25D 1/02* (2013.01); *G03G 15/2057* (2013.01); *C25D 3/12* (2013.01); *G03G 2215/2009* (2013.01); *G03G 2215/2016* (2013.01)

(58) Field of Classification Search
CPC ..... C25D 1/02; C25D 5/48; C25F 3/16–30
See application file for complete search history.

(56) References Cited

U.S. PATENT DOCUMENTS 3,963,587 A * 6/1976 Kreckel ..... C25D 1/00 205/73
8,615,314 B1 * 12/2013 Sonderman ..... G05B 19/41875 700/31

(Continued)

FOREIGN PATENT DOCUMENTS

JP 1-123094 5/1989
JP 4-136182 5/1992

(Continued)

OTHER PUBLICATIONS

Japan Office Action for Application No. 2013-026055 dated Sep. 14, 2016.

*Primary Examiner* — Louis J Rufo
(74) *Attorney, Agent, or Firm* — Nixon & Vanderhye

(57) ABSTRACT

Disclosed is a method for producing an electrocast belt which method ensures long-term use of an electrocasting bath and which method enables provision of an electrocast belt having a required product quality even when an electrocasting bath that has been used in electrolysis with a large cumulative amount of electricity. The method includes a first step of producing an electrocast belt having a required product quality in an electrocasting bath of a specific composition until a predetermined period of time has elapsed; a second step of subsequently producing an electrocast belt in the same electrocasting bath; and a third step of polishing a surface of the electrocast belt produced from the second step so that the electrocast belt produced from the third step has a product quality equivalent to that of the electrocast belt produced from the first step.

10 Claims, 3 Drawing Sheets

(56) References Cited

U.S. PATENT DOCUMENTS

| | | | | |
|---|---|---|---|---|
| 2007/0051619 | A1* | 3/2007 | Mazur | B23H 5/08 204/250 |
| 2011/0276166 | A1* | 11/2011 | Atanasoff | H01L 31/20 700/104 |
| 2011/0308958 | A1* | 12/2011 | Kurrle | C25D 7/00 205/221 |

FOREIGN PATENT DOCUMENTS

| | | |
|---|---|---|
| JP | 10-265927 | 10/1998 |
| JP | 2000-87286 | 3/2000 |
| JP | 2012-212184 | 11/2012 |

* cited by examiner

METHOD OF PRODUCING ELECTROCAST BELT

The entire disclosure of Japanese Patent Application No. 2013-026055 filed on Feb. 13, 2013 is expressly incorporated by reference herein.

BACKGROUND OF THE INVENTION

Field of the Invention

The present invention relates to a method for producing an electrocast belt, which is particularly suitable for a fixation belt or a pressure roller of an image-forming apparatus such as a copying machine, a facsimile machine, or a laser beam printer.

Background Art

Image-forming apparatuses such as a copying machine, a facsimile machine, and a laser beam printer are equipped with a fixation unit, by which an unfixed toner image is fixed on a recording paper sheet. One type of fixation unit includes a fixation belt having an endless electrocast belt serving as a substrate which is to come into contact with a toner image on a recording paper sheet, and a pressure roller disposed so as to face opposite the fixation belt. Inside the fixation belt, there are disposed a pressure member that outwardly presses the fixation belt against the opposite pressure roller, and a supporting member for supporting the pressure member. In such a fixation unit, a recording paper sheet is typically passed through a nip portion between the fixation belt and the pressure roller, whereby the toner image is fixed by means of heat and pressure.

The fixation belt generally employs, as a substrate, an electrocast belt produced through electrocasting by use of an electrocasting bath such as a nickel sulfamate bath or a Watts bath. For enhancement of durability and releasability in production of the electrocast belt, a brightener such as saccharin sodium or butynediol is added to the electrocasting bath (see, for example, Patent Document 1).

However, when electrocast belts are produced in such an electrocasting bath, the electrocasting bath is deteriorated through electrolysis with a large cumulative amount of electricity, and such deterioration may reduce the quality of the produced electrocast belts, which is problematic. In order to prevent quality deterioration of electrocast belts, the electrocasting bath is periodically maintained or replaced. At present, only such countermeasures are taken, resulting in reduced productivity and increased production cost.

Patent Document 1: Japanese Patent Application Laid-Open (kokai) No. 2012-212184

SUMMARY OF THE INVENTION

In view of the foregoing, an object of the present invention is to provide a method for producing an electrocast belt, which method ensures long-term use of an electrocasting bath and which method enables provision of an electrocast belt having a required product quality even when an electrocasting bath that has been used in electrolysis with a large cumulative amount of electricity.

In a first mode of the present invention for attaining the aforementioned object, there is provided a method for producing an electrocast belt by use of an electrocasting bath, the method comprising:

a first step of producing an electrocast belt having a required product quality in an electrocasting bath of a specific composition until a predetermined period of time has elapsed;

a second step of subsequently producing an electrocast belt in the same electrocasting bath; and a third step of polishing a surface of the electrocast belt produced from the second step so that the electrocast belt produced from the third step has a product quality equivalent to that of the electrocast belt produced from the first step.

According to the first mode of the present invention, the electrocast belt which has been produced in the electrocasting bath that has been used in electrolysis with a large cumulative amount of electricity is surface-polished. Thus, the product quality of the electrocast belt produced in the above electrocasting bath can be equivalent to that of the electrocast belt produced in the electrocasting bath before use for the predetermined period of time; i.e., an electrocasting bath which is immediately after initial making up or which has been used in electrolysis with merely a small cumulative amount of electricity.

Preferably, the electrocast belt has at least one metal layer made of a metal selected from nickel and a nickel alloy.

When the metal layer is made from nickel or a nickel alloy, the electrocast belt has excellent durability.

Preferably, the polishing treatment is physical polishing, chemical polishing, or electro-polishing.

Through such a polishing treatment, a high-quality polished surface can be readily obtained.

In a second mode of the present invention, there is provided a method for producing an electrocast belt by use of an electrocasting bath for imparting a target required product quality to the electrocast belt, the method comprising polishing a surface of an electrocast belt produced in an electrocasting bath which has been used for a predetermined period of time, to thereby provide the electrocast belt with a required product quality equivalent to the target required product quality.

According to the second mode of the present invention, the electrocast belt produced in an electrocasting bath which has been used for a predetermined period of time, or which has been used in electrolysis with a large cumulative amount of electricity, is surface-polished. As a result, the product quality of the polished electrocast belt can be enhanced to that of an electrocast belt produced by use of an electrocasting bath for attaining a target required product quality.

According to the present invention, even when an electrocast belt is produced in an electrocasting bath which has been used for a predetermined period of time, or which has been used in electrolysis with a large cumulative amount of electricity, the surface of the produced electrocast belt is polished. Thus, the product quality of the electrocast belt produced in the above electrocasting bath can be equivalent to that of the electrocast belt produced in an electrocasting bath immediately after initially having been made up or which has been used in electrolysis with merely a small cumulative amount of electricity.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

The present inventors have found that, in production of an electrocast belt, when the electrocasting bath is deteriorated, the surface portions of the produced electrocast belts are affected, thereby producing electrocast belts failing to have a required product quality. The present invention has been accomplished on the basis of this finding.

An embodiment of the method for producing an electrocast belt according to the present invention includes a first step of producing an electrocast belt having a required product quality in an electrocasting bath of a specific composition until a predetermined period of time has elapsed; a second step of subsequently producing an electrocast belt in the same electrocasting bath; and a third step of polishing a surface of the electrocast belt produced from the second step so that the electrocast belt produced from the third step has a product quality equivalent to that of the electrocast belt produced from the first step.

As used herein, the term "electrocasting bath of a specific composition until a predetermined period of time has elapsed" refers to an electrocasting bath used for producing an electrocast belt 1 having a required product quality. For example, the electrocasting bath is an electrocasting bath which has been used in electrolysis with a cumulative amount of electricity of 0 kAh (i.e., immediately after initial make-up of electrolytic bath) or more and less than 1,500 kAh. The term "electrocasting bath after the predetermined period of time has elapsed" refers to an electrocasting bath which has been used in electrolysis with a large cumulative amount of electricity, whereby the produced electrocast belt 1 fail to have a required product quality. For example, the electrocasting bath is an electrocasting bath which has been used in electrolysis with a cumulative amount of electricity of 1,500 kAh to 6,000 kAh, or in excess of 6,000 kAh. In this embodiment, an electrocasting bath which has been used in electrolysis with a cumulative amount of electricity of 0 kAh or more and less than 1,500 kAh is employed as the "electrocasting bath of a specific composition until a predetermined period of time has elapsed," and an electrocasting bath which has been used in electrolysis with a cumulative amount of electricity of 1,500 kAh to 6,000 kAh is employed as the "electrocasting bath after the predetermined period of time has elapsed."

As used herein, the term "required product quality" refers to performance characteristics in terms of dimensions, mechanical strength, etc. Also, the "equivalent or the same required product quality" refers to equivalent or the same performance characteristics and also to more excellent performance characteristics.

Figure 1A:
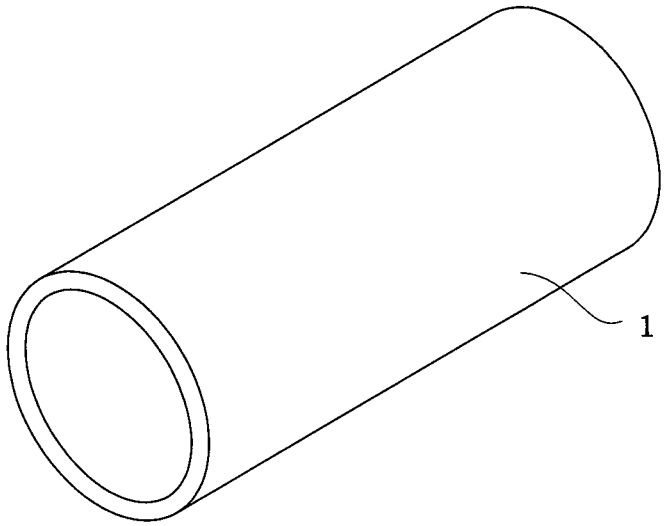
FIG. 1A is a perspective view of an electrocast belt produced in an electrocasting bath which has been used in electrolysis with a cumulative amount of electricity of 0 kAh or more and less than 1,500 kAh.
Figure 1B:
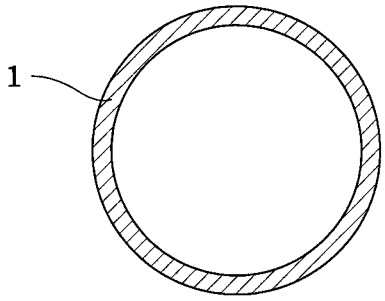
FIG. 1B is a transverse cross-section of the electrocast belt.
Figure 2:
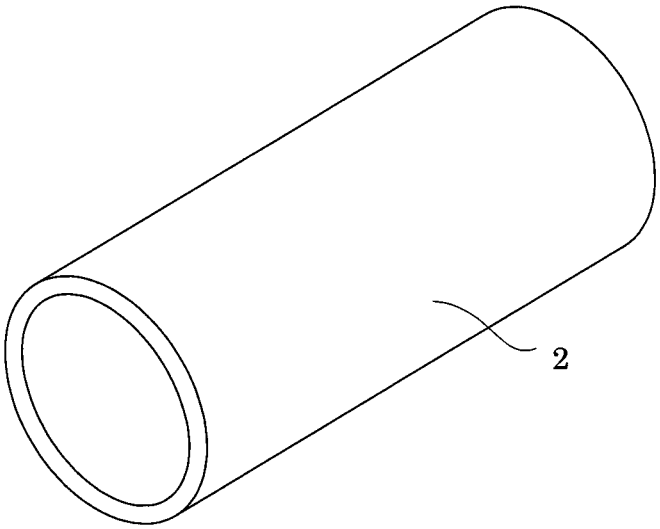
FIG. 2 is a perspective view of an electrocast belt produced in an electrocasting bath which has been used in electrolysis with a cumulative amount of electricity of 1,500 kAh to 6,000 kAh.
Figure 3:
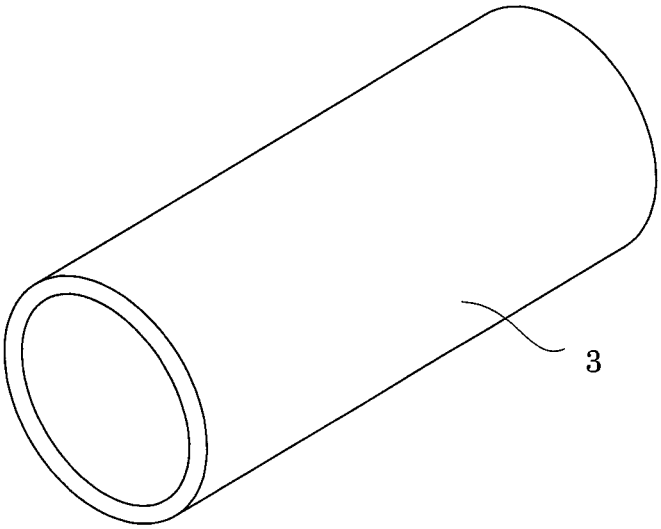
FIG. 3 is a perspective view of an electrocast belt produced in an electrocasting bath which has been used in electrolysis with a cumulative amount of electricity of 1,500 kAh to 6,000 kAh, followed by polishing the surface.

FIG. 1A is a perspective view of the electrocast belt 1 produced in an electrocasting bath which has been used in electrolysis with a cumulative amount of electricity of 0 kAh or more and less than 1,500 kAh, and FIG. 1B is a transverse cross-section of the electrocast belt 1. The electrocast belt 1 has been produced in the first step. FIG. 2 is a perspective view of the electrocast belt 2 produced in an electrocasting bath which has been used in electrolysis with a cumulative amount of electricity of 1,500 kAh to 6,000 kAh. The electrocast belt 2 has been produced in the second step. FIG. 3 is a perspective view of electrocast belt 3 produced in an electrocasting bath which has been used in electrolysis with a cumulative amount of electricity of 1,500 kAh to 6,000 kAh, to thereby produce the electrocast belt 2, followed by polishing the surface of the electrocast belt 2. The electrocast belt 3 has been produced in the third step.

The electrocast belts 1 to 3 shown in FIGS. 1 to 3 are each formed of a metal layer having a hollow cylindrical shape produced through electrocasting performed in the embodiment. The term "electrocasting" refers to an electrolytic metal article production method including forming a thick plating layer on a base, and removing the plating layer from the base.

The electrocast belt 1 produced in an electrocasting bath which has been used in electrolysis with a cumulative amount of electricity of 0 kAh (i.e., immediately after initial make-up of electrolytic bath) or more and less than 1,500 kAh has required product qualities in terms of dimensions (e.g., width (i.e., length in the cylinder axis direction) and thickness), and of mechanical strengths (e.g., tensile strength and bending strength). In order to attain continuous production of the electrocast belt 1 while the required product quality is ensured, the composition of the electrocasting bath, and electrocasting conditions must be optimized.

However, as a large number of electrocast belts 1 are continuously produced in the same electrocasting bath for a long period of time, the electrocasting bath is deteriorated after operation for several months due to electrolysis with a large cumulative amount of electricity. As a result, the produced electrocast belts 1 fail to have a required product quality. In other words, the bending strength and tensile strength of the produced electrocast belts decrease. In the present embodiment, the electrocast belt 2 shown in FIG. 2 is produced. In some cases, the electrocast belt 2 not having a required product quality may be visually detected by, for example, a drop in gloss.

The embodiment of the method for producing an electrocast belt includes polishing the electrocast belt 2, when the electrocast belt 2 fails to have a required product quality due to long-term use of an electrocasting bath, whereby the product quality of the produced electrocast belt 3 is equivalent to that of the electrocast belt 1 produced in an electrocasting bath which has been used in electrolysis with a cumulative amount of electricity of 0 kAh or more and less than 1,500 kAh.

Hereinafter, embodiments of the method of the present invention for producing electrocast belts 1 and 3 will be described in detail.

In the first step, an electrocast belt 1 having a required product quality is produced in an electrocasting bath before use for a predetermined period of time. Specifically, the electrocast belt 1 is produced in an electrocasting bath that has been used in electrolysis with a cumulative amount of electricity of 0 kAh or more and less than 1,500 kAh.

The metal layer forming the electrocast belt 1 is preferably made of a metal such as nickel or aluminum, or an alloy thereof. Among these metal species, nickel or a nickel alloy, having high durability, is particularly preferred. Examples of the nickel alloy include nickel alloys each containing one or more elements selected from among phosphorus, iron, cobalt, manganese, and palladium.

In the case where the metal layer is formed from nickel, the nickel layer is generally formed by use of a nickel electrocasting bath; for example, a Watts bath containing as a predominant component nickel sulfate or nickel chloride, or a sulfamate bath containing as a predominant component nickel sulfamate, with a cylindrical substrate made of stainless steel, brass, aluminum, etc. In the case where the plating substrate is made of a non-conducting material such as silicone resin or gypsum, the non-conducting substrate is subjected to a conducting-property-imparting treatment by use of graphite or copper powder, or through silver mirror reaction, sputtering, or a similar process. In the case where the plating substrate is made of a conductor, the surface of the substrate is preferably subjected to a release-facilitating treatment, for example, forming a release film such as oxide film, compound film, or graphite coating film, in order to facilitate removing the formed nickel plating film from the substrate.

The nickel electrocasting bath contains a nickel ion source, an anode-dissolving agent, a pH buffer, and other additives. Examples of the nickel ion source include nickel sulfamate, nickel sulfate, and nickel chloride. In the case of Watts bath, nickel chloride serves as an anode-dissolving agent. In the case of other nickel baths, ammonium chloride, nickel bromide, and other compounds are used. The nickel plating is generally performed at a pH of 3.0 to 6.2. In order to adjust the pH to fall within the preferred range, a pH buffer such as boric acid, formic acid, nickel acetate, or the like is used. Other additives employed in the nickel electrocasting bath include a brightener, a pit-corrosion-preventing agent, and an internal stress-reducing agent, for the purposes of smoothing, pit corrosion prevention, reducing crystal grain size, reduction of residual stress, etc.

The nickel electrocasting bath is preferably a sulfamate bath. One exemplary composition of the sulfamate bath includes nickel sulfamate tetrahydrate (300 to 600 g/L), nickel chloride (0 to 30 g/L), boric acid (20 to 40 g/L), a surfactant (appropriate amount), and a brightener (appropriate amount). The pH is 2.5 to 5.0, preferably 3.5 to 4.7, and the bath temperature is 20 to 65° C., preferably 40 to 60° C. A metal layer formed of an electrocast nickel alloy may be produced in a nickel metal electrocasting bath appropriately containing a water-soluble phosphorus-containing acid salt (e.g., sodium phosphite), a metal sulfamate salt (e.g., ferrous sulfamate, cobalt sulfamate, or manganese sulfamate), palladium sulfamate, etc. Notably, when a nickel electrocasting bath appropriately containing a water-soluble phosphorus-containing acid salt, a metal sulfamate salt (e.g., ferrous sulfamate, cobalt sulfamate, or manganese sulfamate), palladium sulfamate, and other ingredients, an electrocast seamless belt formed of a nickel alloy containing one or more element selected from among phosphorus, iron, cobalt, manganese, and palladium may be formed. Needless to say, such an electrocast seamless belt may be employed as the metal layer.

As described above, when the metal layer is formed from electrocast nickel, a sulfamate bath is preferably used. Alternatively, a nickel sulfate bath, a Watts bath, or such a bath to which phosphorus, iron, cobalt, manganese, palladium, etc. have been added may also be used. The metal layer may be an electrocast metal layer other than an electrocast nickel layer. The non-nickel metal layer may be produced in a known electrocasting bath.

A plurality of metal layers may be disposed in the electrocast belt 1. In this case, preferably, at least one metal layer is formed of high-durability nickel or a nickel alloy. One exemplary combination of three metal layers is a stacked body of a nickel layer, a copper layer, and a nickel layer.

The electrocast belt 1 produced in the aforementioned electrocasting bath before use for a predetermined period of time has required product qualities; i.e., mechanical strengths including tensile strength and bending strength. Such product qualities are realized, since the electrocast belt 1 is produced in an electrocasting bath that has been used in electrolysis with a cumulative amount of electricity of 0 kAh or more and less than 1,500 kAh.

Subsequently, an electrocast belt 2 is produced in the second step. In the second step, the electrocast belt 2 is produced in an electrocasting bath after the predetermined period of time has elapsed. Specifically, the electrocast belt 2 is produced in an electrocasting bath which has been used in electrolysis with a cumulative amount of electricity of 1,500 kAh to 6,000 kAh.

The method of producing the electrocast belt 2 is identical to the method of producing the electrocast belt 1, except for the conditions of the electrocasting bath. The bath in which the electrocast belt 2 is produced may be different from the electrocasting bath before use for the predetermined period of time and may have a bath composition different from that of the electrocasting bath before use for the predetermined period of time. In the case where an electrocasting bath having a different bath composition is used as an electrocasting bath after the predetermined period of time has elapsed, the bath has been used in electrolysis with a large cumulative amount of electricity and cannot produce the electrocast belt 1 having a required product quality.

The electrocast belt 2 produced in the electrocasting bath after the predetermined period of time has elapsed fails to have a required product quality, since the electrocasting bath has already used in electrolysis with a cumulative amount of electricity of 1,500 kAh to 6,000 kAh.

Subsequently, an electrocast belt 3 is produced in the third step. In the third step, a surface of the electrocast belt 2 produced in the second step is polished. Through this polishing treatment, the electrocast belt 3 has a product quality equivalent to that of the electrocast belt 1 produced in the electrocasting bath before use for the predetermined period of time.

As used herein, the term "polishing" refers to a step of removing a deteriorated surface portion of a metal body, to thereby provide the metal body with a mirror-like and smooth surface. Examples of the polishing step include physical polishing, chemical polishing, and electro-polishing. In physical polishing, a thin portion of a metal surface is polished by means of, for example, sand paper, an abrasive cloth, or a grindstone. In chemical polishing, a metal body is immersed in a chemical polishing agent, to thereby melt the metal surface. In electro-polishing, a metal body is subjected to electrolysis in an electrolyte, to remove a surface portion thereof. The chemical polishing agent used in chemical polishing, or the electrolyte used in electro-polishing may be appropriately selected in accordance with the material of the metal body to be polished.

In a specific polishing procedure, a very thin surface portion of the electrocast belt 2 is polished in a polishing amount of, for example, 0.1 μm to 1.0 μm, to thereby produce the electrocast belt 3 having a required product quality. Since the electrocast belt 3 has been produced through polishing the very thin surface portion of the electrocast belt 2 in a polishing amount of 0.1 μm to 1.0 μm, the required product quality of the electrocast belt 1 can be maintained.

The electrocast belt 2 failing to have a required product quality may be detected by measuring surface roughness. Specifically, when the surface roughness of the electrocast belt 2 is larger than that of the electrocast belt 1 in some cases, the electrocast belt 2 is surface-polished so that the surface roughness thereof is adjusted to that of the electrocast belt 1 or thereabout.

Even though the electrocast belt 2 has no required product quality including mechanical strength, the electrocast belt 3 produced through polishing has a required product quality equivalent to that of the electrocast belt 1 produced in an electrocasting bath before use for the predetermined period of time; i.e., an electrocasting bath that has been used in electrolysis with a cumulative amount of electricity of 0 kAh or more and less than 1,500 kAh. In particular, it has been confirmed that the obtained mechanical strengths including bending strength are equivalent to or more excellent than those of the electrocast belt 1 produced in an electrocasting bath which has been used in electrolysis with a cumulative amount of electricity of 0 kAh (i.e., immediately after initial make-up of electrolytic bath) (see FIG. 4).

According to the present invention, even when the electrocast belt 2 is produced in an electrocasting bath which has been used for a predetermined period of time, the surface of the produced electrocast belt 2 is simply polished. Thus, the electrocast belt 3 has a required product quality equivalent to that of the electrocast belt 1 produced in an electrocasting bath before use for the predetermined period of time, or in an electrocasting bath which has been used in electrolysis with a cumulative amount of electricity of 0 kAh or more and less than 1,500 kAh. Accordingly, intervals of preparation, maintenance, or replacement of electrocasting bath can be prolonged by a factor of two or more, remarkably reducing production cost.

EXAMPLES

The present invention will next be described in detail by way of examples, which should not be construed as limiting the invention thereto.

Six electrocasting baths which had been used in electrolysis with cumulative amount of electricitys of 0 kAh, 1,000 kAh, 1,500 kAh, 3,000 kAh, 4,500 kAh, and 6,000 kAh, respectively, were used. The cumulative amount of electricity serves as a parameter of the service period of each electrocasting bath.

Example 1

In Example 1, the electrocast belt 1 was produced in an electrocasting bath which had been used in electrolysis with a cumulative amount of electricity of 0 kAh (i.e., immediately after initial make-up of electrolytic bath) in the following manner.

A phosphorus sulfamate electrocast bath of interest was prepared from nickel sulfamate (500 g/L), sodium phosphite (150 mg/L), boric acid (30 g/L), trisodium naphthalene-1,3,6-trisulfonate (1.0 g/L) serving as a primary brightener, and 2-butyne-1,4-diol (20 mg/L) serving as a secondary brightener.

While the electrocast bath was maintained at 60° C. and a pH of 4.5, electrocasting was performed with a stainless steel cylindrical substrate (outer diameter: 34 mm) as a cathode, and a depolarized nickel as an anode at a current density of 16 A/dm$^2$, to thereby deposit an electrocast film on the outer surface of the substrate. The thus-deposited film was extracted from the substrate, to thereby yield a metal layer made of electrocast nickel-phosphorus alloy and having an inner diameter of 34 mm and a thickness of 40 μm. The metal layer was found to have a phosphorus content of 0.5 mass %. Surface polishing of the thus-produced electrocast belt 1 was not performed.

Example 2

The procedure of Example 1 was repeated, except that an electrocasting bath which had been used in electrolysis with a cumulative amount of electricity of 1,000 kAh was used, to thereby produce the electrocast belt 1. Surface polishing of the thus-produced electrocast belt 1 was not performed.

Example 3

The procedure of Example 1 was repeated, except that an electrocasting bath which had been used in electrolysis with a cumulative amount of electricity of 1,500 kAh was used, to thereby produce the electrocast belt 2. The thus-produced electrocast belt 2 was surface-polished sequentially with water-resistant sand paper #1500 and #2000. Subsequently, the polished surface was further polished with an abrasive material (Pikal Neri, product of Nihon Maryo Kogyo Co., Ltd., the same will be applied throughout the specification), to thereby produce the electrocast belt 3. The total polish amount was adjusted to about 0.1 μm.

The polish amount was determined as the thickness of the portion removed through polishing. The thickness is defined as the difference between the thickness of an electrocast belt measured before polishing and that measured after polishing. The polish amount was determined by means of a laser microscope (model: VK-8510, product of Keyence corporation). The method was also employed in the polish amount determination in Examples 4 to 8.

Example 4

The procedure of Example 1 was repeated, except that an electrocasting bath which had been used in electrolysis with a cumulative amount of electricity of 3,000 kAh was used, to thereby produce the electrocast belt 2. The thus-produced electrocast belt 2 was surface-polished sequentially with water-resistant sand paper #1500 and #2000. Subsequently, the polished surface was further polished with the aforementioned abrasive material, to thereby produce the electrocast belt 3. The total polish amount was adjusted to about 0.2

Example 5

The procedure of Example 1 was repeated, except that an electrocasting bath which had been used in electrolysis with a cumulative amount of electricity of 4,500 kAh was used, to thereby produce the electrocast belt 2. The thus-produced electrocast belt 2 was surface-polished sequentially with water-resistant sand paper #1500 and #2000. Subsequently, the polished surface was further polished with the aforementioned abrasive material, to thereby produce the electrocast belt 3. The total polish amount was adjusted to about 0.4 μm.

Example 6

The procedure of Example 1 was repeated, except that an electrocasting bath which had been used in electrolysis with a cumulative amount of electricity of 6,000 kAh was used, to thereby produce the electrocast belt 2. The thus-produced electrocast belt 2 was surface-polished sequentially with water-resistant sand paper #1500 and #2000. Subsequently, the polished surface was further polished with the aforementioned abrasive material, to thereby produce the electrocast belt 3. The total polish amount was adjusted to about 1.0 μm.

Example 7

The procedure of Example 1 was repeated, except that an electrocasting bath which had been used in electrolysis with a cumulative amount of electricity of 6,000 kAh was used, to thereby produce the electrocast belt 2. The thus-produced electrocast belt 2 was subjected to chemical polishing by immersing the belt in a nickel chemical polishing liquid (S-clean MY-28, product of Sasaki Chemical Co., Ltd.), to thereby produce the electrocast belt 3. The total polish amount was adjusted to about 1.0 μm.

Example 8

The procedure of Example 1 was repeated, except that an electrocasting bath which had been used in electrolysis with a cumulative amount of electricity of 6,000 kAh was used, to thereby produce the electrocast belt 2. The thus-produced electrocast belt 2 was subjected to electro-polishing by immersing the belt in a nickel sulfamate solution, to thereby produce the electrocast belt 3. The total polish amount was adjusted to about 1.0 μm.

Comparative Example 1

The procedure of Example 1 was repeated, except that an electrocasting bath which had been used in electrolysis with a cumulative amount of electricity of 1,500 kAh was used, to thereby produce the electrocast belt 2. The thus-produced electrocast belt 2 was not subjected to surface polishing.

Comparative Example 2

The procedure of Example 1 was repeated, except that an electrocasting bath which had been used in electrolysis with a cumulative amount of electricity of 3,000 kAh was used, to thereby produce the electrocast belt 2. The thus-produced electrocast belt 2 was not subjected to surface polishing.

Comparative Example 3

The procedure of Example 1 was repeated, except that an electrocasting bath which had been used in electrolysis with a cumulative amount of electricity of 4,500 kAh was used, to thereby produce the electrocast belt 2. The thus-produced electrocast belt 2 was not subjected to surface polishing.

Comparative Example 4

The procedure of Example 1 was repeated, except that an electrocasting bath which had been used in electrolysis with a cumulative amount of electricity of 6,000 kAh was used, to thereby produce the electrocast belt 2. The thus-produced electrocast belt 2 was not subjected to surface polishing.

Test Example 1

The electrocast belts produced in Examples 1 to 8 and Comparative Examples 1 to 4 were cut to provide test pieces each having a width of 15 mm. The test pieces were subjected to a biaxially rotating bending fatigue test.

The test was performed at ambient temperature in air under the following conditions: load; 1.0 kg, rotating shaft; φ15, driven shaft; φ4, and rotation speed; 300 rpm.

Figure 4:
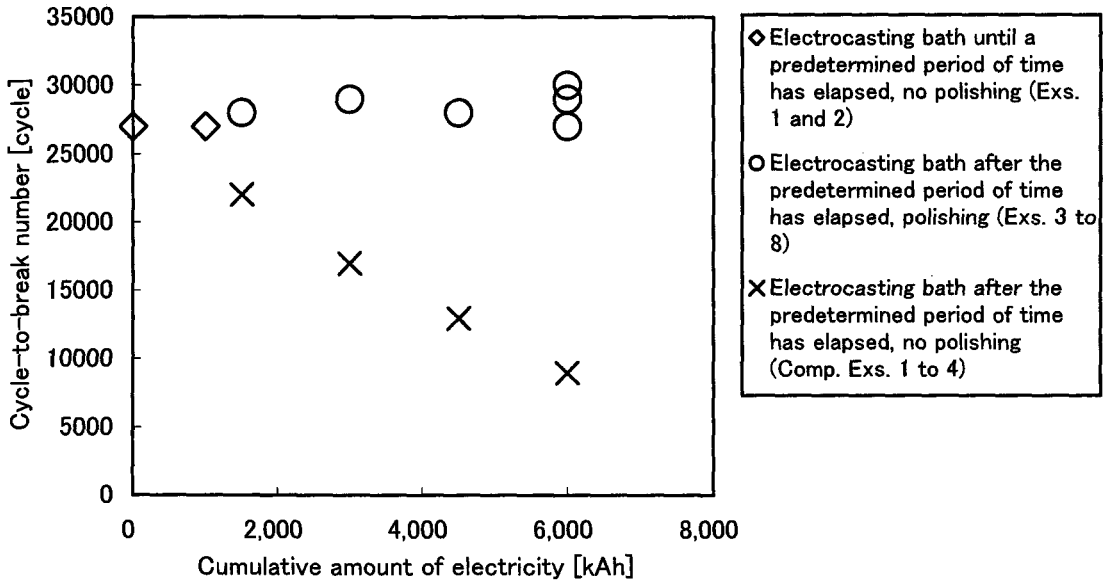
FIG. 4 is a graph showing the relationship between cumulative amount of electricity and the number of cycles to break.

FIG. 4 is a graph showing the relationship between cumulative amount of electricity and the number of cycles to break (i.e., fatigue limit). As shown in FIG. 4, the electrocast belts 3 produced in Examples 3 to 8 exhibited a cycle-to-break number equivalent to or greater than that attained by the electrocast belts 1 produced in Examples 1 and 2. As described above, the electrocast belts 3 produced in Examples 3 to 8 were produced through physical polishing, chemical polishing, or electro-polishing of the electrocast belts 2, which had been produced in an electrocasting bath after the predetermined period of time has elapsed; i.e., which had been used in electrolysis with a cumulative amount of electricity of 1,500 kAh to 6,000 kAh. The electrocast belts 1 were produced in an electrocasting bath which had been used in electrolysis with a cumulative amount of electricity of 0 kAh (immediately after initial make-up of electrolytic bath) (Example 1), or with a cumulative amount of electricity of 1,000 kAh (Example 2). Also, the electrocast belts 3 produced in Examples 1 to 8 exhibited a cycle-to-break number more than that attained by the electrocast belts 2, produced in Comparative Examples 1 to 4 employing an electrocasting bath which had been used in electrolysis with a cumulative amount of electricity of 1,500 kAh to 6,000 kAh.

Particularly, the electrocast belts 3 produced in Examples 6 to 8 through physical polishing, chemical polishing, or electro-polishing of the electrocast belts 2, which had been produced in an electrocasting bath which had been used in electrolysis with a cumulative amount of electricity of 6,000 kAh, exhibited a cycle-to-break number about three times that attained by the electrocast belt 2 (Comparative Example 4) produced in the same electrocasting bath.

As is clear from FIG. 4, through physical polishing, chemical polishing, or electro-polishing of the electrocast belts 2 produced in an electrocasting bath which had been used in electrolysis with a large cumulative amount of electricity, the thus-produced electrocast belts 3 exhibited a cycle-to-break number equivalent to or greater than that attained by the electrocast belts 1, produced in an electrocasting bath which had been used in electrolysis with a cumulative amount of electricity of 0 kAh or <1,500 kAh. In other words, the electrocast belts 3 were found to have excellent mechanical strength.

Test Example 2

The surface roughness Ra of each of the electrocast belts produced in Examples 1 to 8 and Comparative Examples 1 to 4 was determined by means of a surface roughness meter (SURFCOM-1400A, product of Toyo Seiki Co., Ltd.).

As used herein, the term "surface roughness Ra (arithmetic mean roughness)" refers to the average of the sum of absolute values of the depression depth or protrusion height from the center line. In this embodiment, Ra was determined in accordance with the JIS B0601 (1994). Also, the electrocast belts produced in Examples 1 to 8 and Comparative Examples 1 to 4 were visually observed, to thereby evaluate specularity.

Table 1 shows the cumulative amount of electricitys of the electrocasting baths employed in Examples 1 to 8 and Comparative Examples 1 to 4, and the polishing status, surface roughness Ra, specularity, polish amount, and cycle-to-break number of the produced electrocast belts. The surface roughness Ra of electrocast belts of Examples 3 to 8 was measured after physical polishing, chemical polishing, or electro-polishing. The "specularity" is a parameter of surface gloss. Specifically, a surface having high specularity assumes a mirror-like surface, whereas a surface having low specularity has reduced gloss.

number equivalent to or greater than that attained by the electrocast belts 1, produced in an electrocasting bath which had been used in electrolysis with a cumulative amount of electricity of 0 kAh or 1,000 kAh. In other words, the electrocast belts 3 were found to have excellent mechanical strength.

Furthermore, according to the present invention, the electrocasting bath can be effectively used for a long period of time, whereby the number of times of periodic maintenance or replacement of electrocasting bath can be considerably reduced. Thus, productivity of electrocast belts can be enhanced, thereby considerably reducing production cost. The surface roughness Ra and specularity can also be enhanced to those of the electrocast belt 1 produced in an electrocasting bath which has been used in electrolysis with a cumulative amount of electricity of 0 kAh or 1,000 kAh.

TABLE 1

| | Cumulative amount of electricity of electrocasting bath [kAh] | Polishing | Surface roughness Ra [μm] | Specularity [—] | Polish amount [μm] | Cycle-to-break no. |
|---|---|---|---|---|---|---|
| Ex. 1 | 0 | no | 0.05 | high | — | 27,000 |
| Ex. 2 | 1,000 | no | 0.05 | high | — | 27,000 |
| Ex. 3 | 1,500 | yes (physical) | 0.05 | high | 0.1 | 28,000 |
| Ex. 4 | 3,000 | yes (physical) | 0.04 | high | 0.2 | 29,000 |
| Ex. 5 | 4,500 | yes (physical) | 0.06 | high | 0.4 | 28,000 |
| Ex. 6 | 6,000 | yes (physical) | 0.04 | high | 1.0 | 27,000 |
| Ex. 7 | 6,000 | yes (chemical) | 0.03 | high | 1.0 | 30,000 |
| Ex. 8 | 6,000 | yes (electro-) | 0.04 | high | 1.0 | 29,000 |
| Comp. Ex. 1 | 1,500 | no | 0.07 | slightly low | — | 22,000 |
| Comp. Ex. 2 | 3,000 | no | 0.11 | low | — | 17,000 |
| Comp. Ex. 3 | 4,500 | no | 0.18 | low | — | 13,000 |
| Comp. Ex. 4 | 6,000 | no | 0.28 | low | — | 9,000 |

Figure 5:
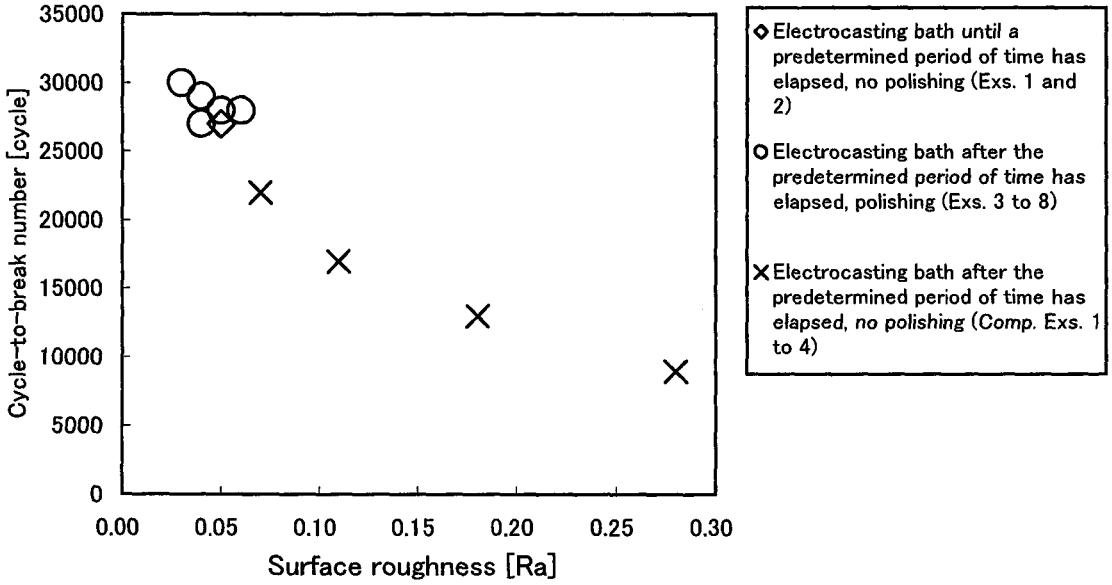
FIG. 5 is a graph showing the relationship between surface roughness Ra and the number of cycles to break.

FIG. 5 is a graph showing the relationship between surface roughness Ra and cycle-to-break number. As shown in FIG. 5, the electrocast belts 3 of Examples 3 to 8 had a surface roughness Ra as small as that of the electrocast belt 1 produced in Example 1 employing an electrocasting bath which had been used electrolysis with a cumulative amount of electricity of 0 kAh or that of the electrocast belt 1 produced in Example 2 employing an electrocasting bath which had been used electrolysis with a cumulative amount of electricity of 1,000 kAh. The electrocast belts 3 of Examples 3 to 8 had a cycle-to-break number equivalent to or greater than that of the electrocast belts 1 of Examples 1 and 2.

As is also clear from Table 1, the electrocast belts of Examples 1 to 8 had high specularity. Thus, through physical polishing, chemical polishing, or electro-polishing of the electrocast belts 2 produced in an electrocasting bath which had been used in electrolysis with a large cumulative amount of electricity, the thus-produced electrocast belts 3 had specularity equivalent to that attained by the electrocast belts 1, produced in an electrocasting bath which had been used in electrolysis with a cumulative amount of electricity of 0 kAh or 1,000 kAh.

The Test Examples 1 and 2 have revealed the following. In the method of the present invention for producing an electrocast belt, through physical polishing, chemical polishing, or electro-polishing of the electrocast belts 2 produced in an electrocasting bath which had been used in electrolysis with a large cumulative amount of electricity and which cannot ensure a required product quality, the thus-produced electrocast belts 3 exhibited a cycle-to-break

Other Embodiments

One embodiment of the present invention has been described hereinabove. However, the embodiment should not be construed as limiting the present invention thereto.

Embodiment 1 of the method for producing an electrocast belt includes the first to third steps. It may be the case that, among the three steps, only the second and third steps are carried out. More specifically, the electrocast belt 2 is produced in an electrocasting bath after a predetermined period of time has elapsed. Then, a surface of the electrocast belt 2 is polished. Through this polishing treatment, the electrocast belt 2 failing to have a required product quality can be converted to the electrocast belt 3 having a required product quality.

In the case where the electrocast belt has a plurality of stacked metal layers, the method of the present invention for producing an electrocast belt may be applied to at least one metal layer among the metal layers.

The electrocast belts 1 and 3 produced through the production method of the present invention are suitably employed as a base of a fixation belt, or may be employed as a base of, for example, a transfer/fixation belt for fixing an image immediately after image transfer. Thus, no particular limitation is imposed on the mode of use of the electrocast belt.

What is claimed is:

1. An electrocast belt production method by use of an electrocasting bath, the method comprising:

a first step of producing a first set of electrocast belts having a required product quality without polishing a surface of any of the first set of electrocast belts in an electrocasting bath of a specific composition, wherein, in the first step, the first set of electrocast belts are produced without polishing a surface thereof, using an electrocasting bath which has been used in electrolysis with a cumulative amount of electricity of 0 kAh or more and less than 1,500 kAh, until the electrocasting bath has been used for a predetermined period whereby a produced electrocast belt fails to have the required product quality, and a second step of producing a second set of electrocast belts in the electrocasting bath which has been used for the predetermined period in the first step, wherein, in the second step, each of the electrocast belts of the second set of electrocast belts are produced with polishing a surface thereof, using the electrocasting bath which has been used in electrolysis in the first step with a cumulative amount of electricity of at least 1,500 kAh, so that each of the electrocast belts produced in the second step has the required product quality.

2. The electrocast belt production method according to claim 1, wherein each electrocast belt has at least one metal layer made of a metal selected from nickel and a nickel alloy.

3. The electrocast belt production method according to claim 1, wherein the polishing is physical polishing.

4. The electrocast belt production method according to claim 2, wherein the polishing is physical polishing.

5. The electrocast belt production method according to claim 1, wherein the polishing is chemical polishing.

6. The electrocast belt production method according to claim 2, wherein the polishing is chemical polishing.

7. The electrocast belt production method according to claim 1, wherein the polishing is electro-polishing.

8. The electrocast belt production method according to claim 2, wherein the polishing is electro-polishing.

9. The electrocast belt production method according to claim 1, wherein, during the first step, the electrocasting bath has a cumulative amount of electricity less than a first amount of cumulative electricity, and during the second step, the electrocasting bath has a cumulative amount of electricity greater than the first amount of cumulative electricity and less than a maximum amount of cumulative electricity.

10. The electrocast belt production method according to claim 1, wherein, during the second step, the electrocasting bath, which has been used in electrolysis in the first step, has a cumulative amount of electricity of 1,500 kAh to 6,000 kAh.

* * * * *